US007109886B2

(12) United States Patent
Jacobs

(10) Patent No.: US 7,109,886 B2
(45) Date of Patent: Sep. 19, 2006

(54) TRAFFIC CONTROL MALFUNCTION MANAGEMENT UNIT WITH CO-CHANNEL MONITORING

(75) Inventor: Allen Jacobs, Reno, NV (US)

(73) Assignee: Reno A&E, Reno, NV (US)

( * ) Notice: Subject to any disclaimer, the term of this patent is extended or adjusted under 35 U.S.C. 154(b) by 61 days.

(21) Appl. No.: 10/719,269

(22) Filed: Nov. 20, 2003

(65) Prior Publication Data

US 2005/0110657 A1 May 26, 2005

(51) Int. Cl.
*G08G 1/095* (2006.01)

(52) U.S. Cl. ..... 340/931; 340/907; 340/642

(58) Field of Classification Search ..... 340/907, 340/908.1, 916, 931, 642, 515, 914, 923, 340/918; 73/1.01, 865.6
See application file for complete search history.

(56) References Cited

U.S. PATENT DOCUMENTS 4,383,240 A * 5/1983 Staats, Jr. ..... 340/915
4,586,041 A * 4/1986 Carlson ..... 340/931
4,734,862 A * 3/1988 Marcus et al. ..... 701/117
5,734,116 A * 3/1998 Schaeffer ..... 73/865.6

OTHER PUBLICATIONS

Eberle Design Inc., Operations Manual-MMU-16E-BS-Series RMS signal Monitor, Jan. 2001, Eberle Design INC., Sections 1-8- DOC #2.*
"To Whom It May Concern"- DOC#1, 1 page.*

* cited by examiner

*Primary Examiner*—Anh V. La

(57) ABSTRACT

A method and apparatus for monitoring for Red Fail faults in a traffic signal control system. Traffic control signals generated by a traffic control unit are grouped into channels. A parent-child relationship is established between some channels. When testing for a Red Fail fault, the control signals in both the parent channel and the child channel are examined. A Red Fail fault will occur only if all the control signals examined in both the parent and the child channel are inactive. The control signals examined in the child channel can be limited to the Green and Walk signals; or may include the Yellow signals.

12 Claims, 2 Drawing Sheets

TRAFFIC CONTROL MALFUNCTION MANAGEMENT UNIT WITH CO-CHANNEL MONITORING

BACKGROUND OF THE INVENTION

This invention relates to traffic control equipment used to monitor the states of traffic signal head control signals for proper operation. More particularly, this invention relates to a malfunction management unit which monitors for the absence of any activated traffic signal head control signals in a given channel.

Traffic signal heads are commonly used to regulate the flow of vehicular and pedestrian traffic. A typical traffic signal head is provided with red, yellow, and green A.C. operated light sources, and the operation of these light sources is under the control of a unit termed a controller assembly. For safety reasons, the traffic control industry has long used equipment to monitor the states of the electrical power signals generated by the controller assembly and used to operate the traffic signal head light sources for proper operation. Under the TS-1 standard, this equipment is called a conflict management unit (CMU); under the later TS-2 standard, this equipment is called a malfunction management unit (MMU).

A controller assembly and an MMU are typically configured together in one of two configurations-Type 16 and Type 12. In either configuration, the traffic control signals from the controller assembly to the signal heads in a controlled intersection are typically grouped into channels, with the signals for a given phase assigned to the same channel. In a Type 16 configuration, there are a total of sixteen channels, each consisting of three 120 volt A.C. outputs:Green/walk, Yellow, and Red/Don't Walk. In a Type 12 configuration there are a total of twelve channels, each consisting of four 120 volt A.C. outputs: Green, Yellow, Walk, and Red.

One of the tests customarily applied to the control signals in each channel is termed the Red Fail test. This test checks whether at least one of the traffic light control signals in a channel is active. If not, all the lights controlling that phase of the intersection are dark and the phase is uncontrolled. When this condition occurs, the MMU generates a fault signal and the traffic signals are forced into a flashing mode of operation, overriding the normal mode of operation.

Although the Red Fail test is widely used, this standard test is inaccurate and not suitable for some intersection arrangements. For example, in some overlaps and some protected/permitted applications it may be required that the lights in one channel all be dark while another channel's lights are active. Under the normal Red Fail test, the absence of an active light in the one channel would trigger a Red Fail fault unless the MMU were programmed to inactivate the Red Fail test.

SUMMARY OF THE INVENTION

The invention comprises a malfunction management unit for traffic signal control equipment with co-channel monitoring which allows the selection of other channels to be Red Fault tested along with a parent channel so that a Red Fault will only occur if the parent channel has no outputs on and the Green, Walk, and optionally the Yellow, of the child channels have no output on. Co-channel monitoring is configured for each channel individually as a one way relationship, i.e. when a channel is programmed as a child of another channel there is no implied reverse relationship.

From an apparatus standpoint, the invention comprises a malfunction management unit for a traffic control unit for monitoring traffic control signals for a Red Fail fault in which no signal is active in a given channel, the malfunction management unit having input terminals for receiving control signals grouped in channels and used to operate the traffic control lights; assignment means for establishing a parent channel-child channel relationship for the purpose of Red Fail fault testing; monitoring means for detecting a Red Fail fault from the signals in the parent channel and the child channel; and an output for controlling the operation of an output relay used to transfer the operation of the traffic control lights to a flashing mode of operation when such a Red Fail is detected.

The malfunction management unit preferably includes a manually settable switch for enabling and disabling the monitoring means and a display for indicating whether a Red Fail fault has occurred.

The child channel usually has Green, Walk, and Yellow control signals; and the monitoring means can be optionally configured to either ignore the Yellow signals for Red Fail testing or include the Yellow signals for Red Fail testing.

From a process standpoint, the invention comprises a method of monitoring for Red Fail faults in a traffic control system for coordinated operation of a plurality of traffic control lights; the method comprising the steps of providing a plurality of input terminals for receiving control signals grouped in channels and used to operate the traffic control lights; establishing a parent channel-child channel relationship for the purpose of Red Fail fault testing; detecting a Red Fail fault from the signals in the parent channel and the child channel; and controlling the operation of an output relay used to transfer the operation of the traffic control lights to a flashing mode of operation when such a Red Fail is detected.

The method preferably includes the step of providing a manually settable switch for enabling and disabling the monitoring means. The method may further include the step of providing a display for indicating whether a Red Fail fault has occurred.

The method may be optionally performed on only the Green and Walk signals in the child channel; or may be performed using the Green, Walk, and Yellow signals in the child channel.

The invention provides enhanced flexibility for MMUs by providing for Red Fail tests on paired channels to account for alternate intersection configurations for which the Red Fail test is not readily suitable.

For a fuller understanding of the nature and advantages of the invention, reference should be had to the ensuing detailed description taken in conjunction with the accompanying drawings.

DETAILED DESCRIPTION OF THE PREFERRED EMBODIMENTS

Figure 1:
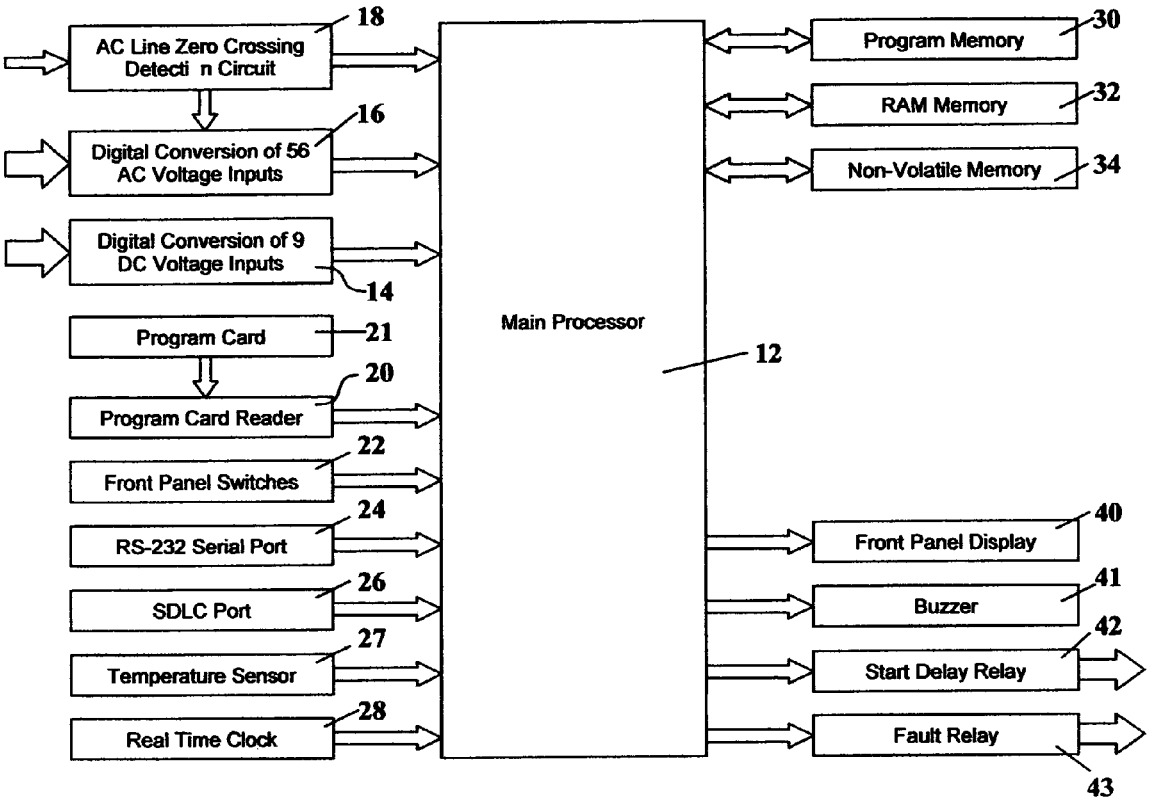
FIG. 1 is a block diagram of a malfunction management unit incorporating the invention.

Turning now to the drawings, FIG. 1 is a block diagram of a malfunction management unit incorporating the invention. As seen in this Fig., the malfunction management unit (MMU) includes a main processor 12, preferably an AMD Am186CH-40 16-bit microprocessor, and nine microcontrollers. One of these microcontrollers designated with reference numeral 14 is used for digital conversion of nine D.C. voltage inputs from the several D.C. voltage sources used in the associated traffic control system. This microcontroller is preferably an Atmel AT90LS8535 device. Seven of the microcontrollers collectively designated with reference numeral 16 are used for digital conversion of fifty six A.C. voltage inputs from the traffic control unit, with each microcontroller handling eight A.C. voltage inputs. An A.C. line zero crossing unit 18 provides zero crossing information to main processor 12. A program card reader 20 provides programming information relating to configuration parameters read from a programming card 21 described in detail below. A plurality of settable switches 22 mounted on the front panel of the MMU housing enable operator selection of several different functions for individual channels as described more fully below. An RS-232 serial port 24 enables communications between the MMU and a laptop computer for local communications and a modem for remote communications. An SDLC port 26 enables communications with the traffic controller. A temperature sensor 27 is provided to monitor the temperature inside the cabinet housing the MMU and the traffic controller. A real time clock 28 provides a real time reference for the main processor.

The main processor 12 is coupled to a program memory unit 30, RAM memory unit 32 and non-volatile memory unit 34. The purpose of each of these memory units is described more fully below. Main processor is also coupled to a front panel display 40 shown in FIG. 2; an audible buzzer 41; a start delay relay 42; and a fault relay 43. The structure and function of units 40–43 are described more fully below.

Figure 2:
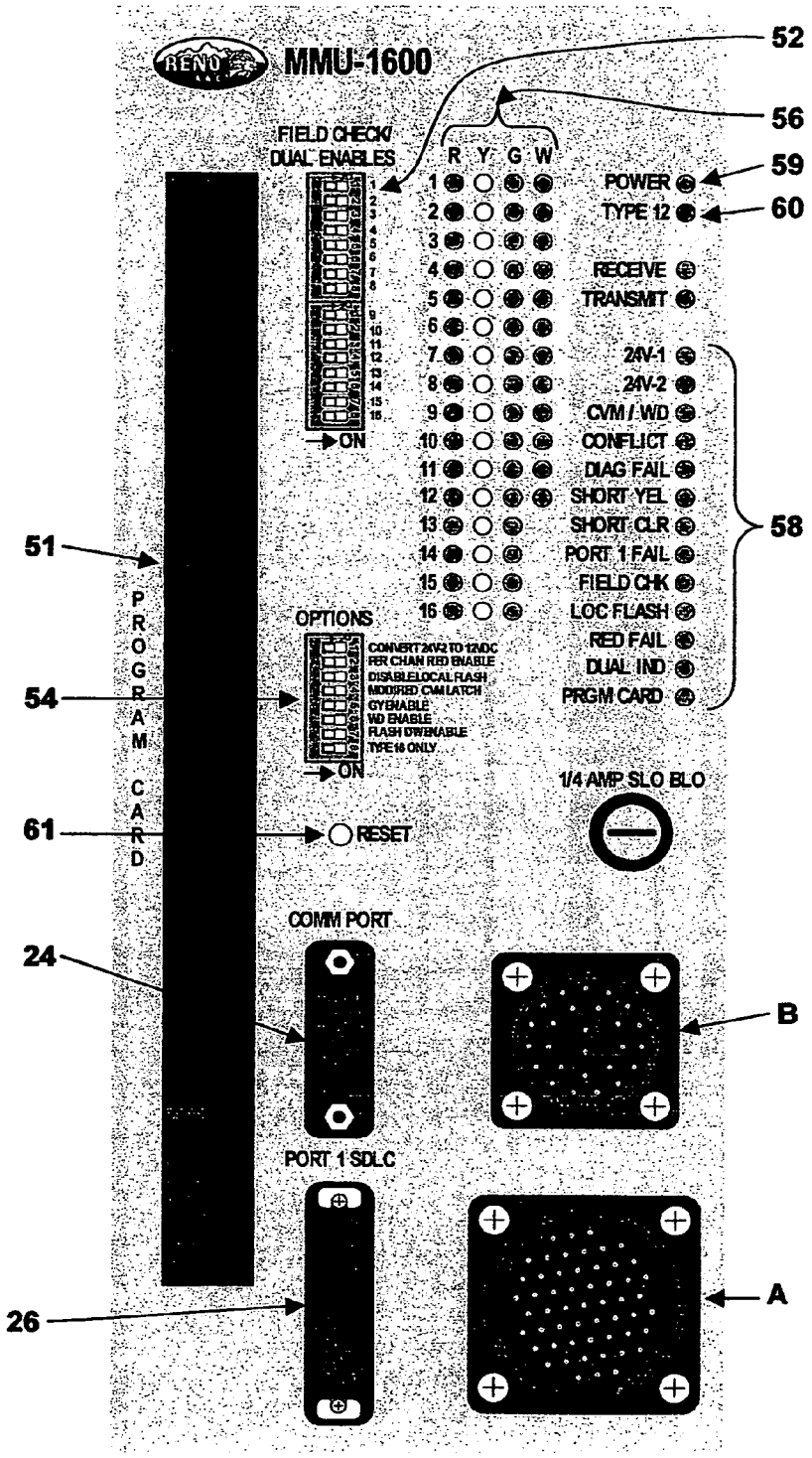
FIG. 2 is a view of the front panel of the malfunction management unit of FIG. 1 showing the settable switches and displays incorporated into the preferred embodiment of the invention.

FIG. 2 illustrates the front panel of the MMU. As seen in this Fig., a program card slot 51 enables a user to insert and remove programming card 21. Sixteen two position switches 52 enable operator selection of the Field Check/Dual Enable functions described more fully below on a per channel basis. Eight two position switches 54 enable operator selection of different options. These options are termed "Convert 24 V-2 to 12VDC"; "Per Channel Red Enable"; "Disable Local Flash"; "Modified CVM Latch"; "GY Monitoring Enable"; "Watchdog Enable"; "Flash DW Enable"; and "Type 16 Only" and are individually described in detail below.

A first display group 56 comprising sixty LED indicators provides field status indications for the various Red, Yellow, Green and Walk field inputs. A second display group 58 provides fault information relating to the status of specific fault conditions and whether the particular fault test is enabled or disabled. A pair of connectors (A and B) provide electrical connections for the various input signals described above with reference to FIG. 1.

A Power LED 59 indicates whether power is being applied to the MMU; while a Type 12 LED 60 indicates whether the user has selected Type 12, Type 16, or Type 16 only modes of operation, described below. Lastly, a Reset button switch 61 enables a technician to attempt manual reset of faults recorded by the MMU. Pushing this button also turns on all display LEDs for a period of time sufficient to visually determine if all LEDs are operational.

CO-CHANNEL MONITORING

The present invention is directed to the Co-Channel Monitoring incorporated into the MMU described herein. When this function is enabled, a Red Fail test is applied to signals in both a parent channel and a child channel, and a Red Fault will only occur if all lights in the parent channel are inactive at the same time as the Green and Walk of the child channel. In an alternate configuration, the Yellow of the child is also included in the Red Fail test so a Red Fault will only occur if all lights in the parent channel are inactive at the same time that the Green, Walk, and Yellow of the child channel are inactive.

Co-channel monitoring is configured for each channel, individually, through software implementation. When a channel is programmed as the child of another channel, it is a one way relationship. For example, if channel 9 is assigned as a child of channel 2, there is no implied reverse relationship of channel 2 being a child of channel 9. If this operation is desired, it must be explicitly programmed as such.

Co-Channel monitoring is enabled for the MMU by operating the PER CHAN RED ENABLE option switch in switch group 54 to the ON position. When enabled the Co-Channel monitoring function examines the signal lines for both the parent channel and the child channel when conducting a Red Fail test. If the "Co-Channel Childs Includes Yellow" option is not specified, a Red Fail fault will be diagnosed if no signal in the parent channel is active and the Green and Walk signals in the child channel are inactive. If the "Co-Channel Childs Includes Yellow" option is specified, a Red Fail fault will be diagnosed if no signal in the parent channel is active and the Green, Walk and Yellow signals in the child channel are all inactive. In the preferred embodiment, the requisite inactivity must persist for at least 1,000 milliseconds before a Red Fail fault is generated.

As will now be apparent to those skilled in the art, malfunction management units provided with the Co-Channel monitoring feature adds a flexible feature to an MMU which enables use of the Red Fail test in intersection configurations for which this test would not be feasible.

A complete description of the MMU comprising the preferred embodiment of the invention is attached hereto as Appendix A and forms an integral part of this disclosure.

Although the above provides a full and complete disclosure of the preferred embodiments of the invention, various modifications, alternate constructions and equivalents will occur to those skilled in the art. For example, although specific microprocessors and microcontrollers have been identified for the preferred embodiment, other such devices may be employed in the implementation of the invention. Therefore, the above should not be construed as limiting the invention, which is defined by the appended claims.

What is claimed is:

1. In a traffic control system for coordinated operation of a plurality of traffic control lights; a malfunction management unit having input terminals for receiving control signals grouped in channels and used to operate the traffic control lights; assignment means for selectively establishing a parent channel-child channel relationship between selected ones of said channels for the purpose of Red Fail fault testing; monitoring means for detecting a Red Fail fault from the signals in the parent channel and the child channel and for generating a Red Fail fault signal when all parent channel signals and some child channel signals are concurrently inactive; and an output coupled to said monitoring means for controlling the operation of an output relay used to transfer the operation of the traffic control lights to a flashing mode of operation when such a Red Fail fault is detected.

2. The system of claim 1 wherein said malfunction management unit includes a manually settable switch for enabling and disabling said monitoring means.

3. The system of claim 1 wherein said malfunction management unit includes a display for indicating whether a Red Fail fault has occurred.

4. The system of claim 1 wherein said child channel has Green, Walk, and Yellow control signals; and wherein said some child channel signals comprise said Green and Walk control signals for Red Fail fault testing.

5. The system of claim 1 wherein said child channel has Green, Walk, and Yellow control signals; and wherein said some child channel signals comprise said Green, Walk, and Yellow control signals for Red Fail fault testing.

6. The system of claim 1 wherein said monitoring means includes delay means for establishing a minimum time period during which all parent channel signals and some child channel signals are concurrently inactive before permitting the generation of said Red Fail fault signal.

7. A method of monitoring for Red Fail faults in a traffic control system for coordinated operation of a plurality of traffic control lights; said method comprising the steps of:

(a) providing a plurality of input terminals for receiving control signals grouped in channels and used to operate the traffic control lights;

(b) selectively establishing a parent channel-child channel relationship between selected ones of said channels for the purpose of Red Fail fault testing;

(c) detecting a Red Fail fault from the signals in the parent channel and the child channel by generating a Red Fail fault signal when all parent channel signals and some child channel signals are concurrently inactive; and (d) controlling the operation of an output relay used to transfer the operation of the traffic control lights to a flashing mode of operation when such a Red Fail fault is detected.

8. The method of claim 7 further including the step of providing a manually settable switch for enabling and disabling said step (c) of detecting.

9. The method of claim 7 further including the step of providing a display for indicating whether a Red Fail fault has occurred.

10. The method of claim 7 wherein said child channel has Green, Walk, and Yellow control signals; and wherein said step (c) of detecting includes the step of generating a Red Fail fault signal when all parent channel signals and said Green and Walk control signals are concurrently inactive.

11. The method of claim 7 wherein said child channel has Green, Walk, and Yellow control signals; and wherein said step (c) of detecting includes the step of generating a Red Fail fault signal when all parent channel signals and said Green, Walk and Yellow control signals are concurrently inactive.

12. The method of claim 7 wherein said step (c) includes the step of waiting a minimum time period during which all parent channel signals and some child channel signals are concurrently inactive before generating the Red Fail fault signal.

* * * * *